United States Patent [19]

Imai et al.

[11] 4,425,604

[45] Jan. 10, 1984

[54] ILLUMINATING DEVICE FOR A DISPLAY UNIT

[75] Inventors: Hiroshi Imai, Yokosuka; Fukashi Sugasawa, Yokohama, both of Japan

[73] Assignee: Nissan Motor Company, Limited, Yokohama, Japan

[21] Appl. No.: 444,695

[22] Filed: Nov. 26, 1982

[30] Foreign Application Priority Data

Feb. 15, 1982 [JP] Japan ..... 57-18448[U]

[51] Int. Cl.[3] ..... F21S 3/00

[52] U.S. Cl. ..... 362/223; 40/582; 362/225; 362/240; 362/241; 362/247; 362/297; 362/307; 362/308; 362/310; 362/318; 362/328; 362/329; 362/330; 362/346; 362/347; 362/348; 362/349

[58] Field of Search ..... 40/582; 362/223, 225, 362/240, 241, 247, 297, 307, 308, 310, 318, 328, 362/329, 330, 346, 347, 348, 349

[56] References Cited

U.S. PATENT DOCUMENTS 4,287,554 9/1981 Wolff ..... 362/241

4,344,111 8/1982 Ruud et al. ..... 362/241

*Primary Examiner*—Stephen J. Lechert, Jr.

*Attorney, Agent, or Firm*—Lane, Aitken & Kananen

[57] ABSTRACT

An illuminating device for a display unit in which the display panel can be illuminated uniformly under a relatively constant luminous intensity. The illuminating device according to the present invention comprises a display panel, at least one light source and a reflector the inner surface of which is defined by at least two elliptical surfaces. One of two foci of each of the elliptical surfaces is located at the center of the light source and the other of two foci thereof is located on the inner surface of said display panel in order to focus rays of light reflected by the reflector on an area on the display panel away from the light source.

16 Claims, 3 Drawing Figures

ILLUMINATING DEVICE FOR A DISPLAY UNIT

BACKGROUND OF THE INVENTION

1. Field of the Invention

The present invention relates generally to an illuminating device used for a display unit, and more particularly to a light reflector used with a light-transmission type display unit, for instance, such as a liquid crystal display unit in which a plurality of light sources are arranged between the display panel and the light reflector at regular intervals.

2. Description of the Prior Art

Recently, various light-transmission type display units such as liquid crystal display or electrochromic display have been utilized for displaying various indications outputted from a device or apparatus or instruments arranged in a dashboard of, for instance, an automotive vehicle.

The liquid crystal display unit can be classified into roughly three types from the standpoint of light-transmitting method, that is, full transmission type, half transmission type, and reflection type. In the full transmission type, the light source is usually disposed at the back of a liquid crystal display panel in order to display some letters or figures in dependence upon the light emitted from the light source. In the half transmission type, the light source is usually disposed at the back of a liquid crystal display panel and a half mirror is additionally provided between the display panel and the light source in order to display some letters or figures in dependence upon the light received from the outside in the daytime and the light emitted from the light source in the nighttime. In the reflection type, a reflector plate is usually disposed at the back of a display panel in order to display some letters or figures in dependence upon the light received only from the outside.

In the transmission type display unit, since a point source such as bulb lamp or a line light source such as fluorescent lamp is used, it is not easy to display the figures on the liquid crystal display panel under a uniform brightness. To overcome this non-uniformity in brightness on the display panel, a parabolic reflector or a diffusion plate (diffuse reflector) is used, being disposed at the back of the liquid crystal display panel. In the case of the parabolic reflector, there exists a problem in that the brightness on the display panel is not satisfactorily uniform; in the case of the diffusion plate, there exists a problem in that an additional element is required and further the brightness is reduced markedly throughout the display panel.

A more detailed description of the prior-art parabolic reflector used with a display unit will be made with reference to the attached drawing under Detailed Description of the Preferred Embodiment.

SUMMARY OF THE INVENTION

With these problems in mind, therefore, it is the primary object of the present invention to provide an illuminating device used with a light-transmission type display unit which can illuminate the display panel relatively uniformly throughout the display panel.

To achieve the above-mentioned object, the illuminating device for a display unit according to the present invention comprises a reflector plate, the inner surface of which is made up of a plurality of unit cells. The contours of each of the unit cells are defined by the union of a pair of ellipses or ellipsoids in such a way that a common focus thereof is located at the center of a light source disposed between the display panel and the reflector plate and the other foci thereof are located on the display panel opposite to the boundaries between two unit cells, the dimension of the ellipses or ellipsoids being determined on the basis of the intervals between two adjacent light sources.

BRIEF DESCRIPTION OF THE DRAWINGS

The features and advantages of the illumination device for a display unit according to the present invention over the prior-art illumination device will be more clearly appreciated from the following description of the preferred embodiment of the invention taken in conjunction with the accompanying drawings in which like reference numerals designate the same or similar elements or sections throughout the figure thereof and in which.

DETAILED DESCRIPTION OF THE PREFERRED EMBODIMENTS

To facilitate understanding of the present invention, a brief reference will be made to a prior-art illumination device provided with a parabolic reflector used with a liquid crystal display unit, with reference to the attached drawing.

Figure 1:
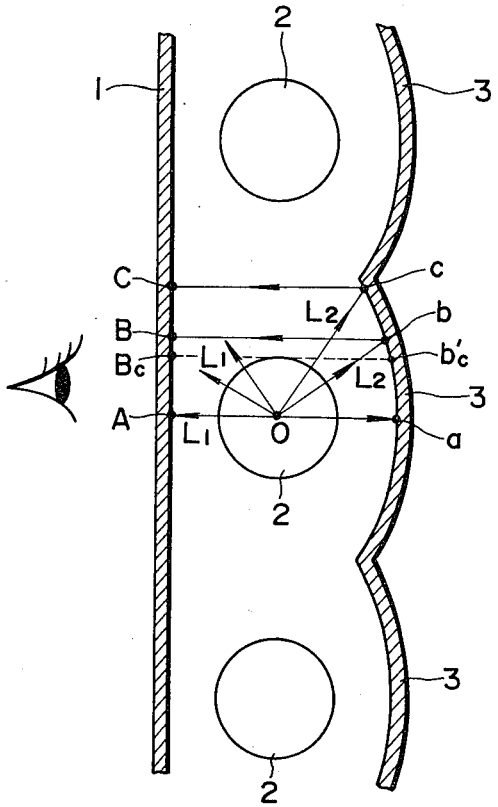
FIG.1 PRIOR ART
FIG. 1 is a sectional diagrammatic view of a prior-art illumination device including a parabolic reflector used with a liquid crystal display unit.

FIG. 1 is a sectional view showing a prior-art illumination device in which tubular light sources such as fluorescent lamps are arranged at the back of a display panel at regular intervals.

In the figure, the reference numeral 1 denotes a liquid crystal panel on which letters or figures are displayed; the reference numeral 2 denotes a plurality of fluorescent lamps arranged at the back of the display panel 1; and the reference numeral 3 denotes a reflector plate. The inner surface of the reflector plate 3 is made up of a plurality of unit cells: the contour of each of which is defined by a part of a parabolic cylinder surface having the focus coincident with the center of a tubular light source disposed between the display panel 1 and the reflector plate 3. Further, in FIG. 1, the axis of the tubular light source is perpendicular to the place defined by the foci of the corresponding unit cells.

In FIG. 1 rays $L_1$ of light emitted from the center of the fluorescent lamp 2 are allowed to be directly incident upon the inner surface of the liquid crystal display panel 1; rays $L_2$ of light emitted from the fluorescent lamp 2 are allowed to be indirectly and perpendicularly incident upon the inner surface of the liquid crystal display panel 1 after having been reflected by the reflector 3 defined by parabolic cylinder surfaces.

Since the center O of the fluorescent lamp 2 is located at the center of the parabolic cylinder surface of the reflector 3, it is possible to effectively utilize the whole rays of light emitted from the light source 2 for displaying the figures developed on the liquid crystal display panel 1. However, the brightness (the luminous intensity) is not uniform on the display panel 1. Here, the rays of light emitted from only a half of the fluorescent lamp 2 are discussed in more detail with respect to brightness at points A, B and C on the display panel 1.

With respect to the rays $L_1$ of light directly allowed to be incident upon the panel 1, since the distance between points A and O is the shortest, the distance between points B and O is the medium, and the distance between points C and O is the longest, the luminous flux density is the greatest at point A, the medium at point B and the smallest at point C. On the other hand, with respect to the rays $L_2$ of light allowed to be incident upon the display panel 1 after reflected by the reflector 3, since the distance between points a and O is the shortest, the distance between points b and O is the medium and the distance between points c and O is the longest (points a, b and c are located on the straight lines perpendicular to points A, B and C on the display panel surface), the luminous flux density is the greatest at point a, the medium at point b, and the smallest at point c. Further, as understood by FIG. 1, the rays of light reflected by the reflector surface area between points a and $b_c$ are not incident upon the display panel 1 being intercepted by the outer surface of the fluorescent lamp 2.

Accordingly, the area between points A and $B_c$ on the display panel upon which the rays $L_1$ are directly incident is relatively brighter because the area is near the light source 2; in particular, point A is the brightest; the area between points $B_c$ and C upon which the rays $L_1$ and the rays $L_2$ are directly or indirectly (after reflected) incident is relatively darker because the area is far away from the light source 2; in particular, the point C is the darkest. As described above, the surface of the liquid crystal display panel 1 is not illuminated uniformly throughout the display panel, thus resulting in a problem in that letters or figures are not legible or distinguishable on the display panel.

Further, to overcome the problem described above, there exists an illumination device used with a liquid display unit which includes a diffusing plate to diffuse the light emitted from the light source and a scattering plate to scatter the light diffused through the diffusing plate, with both the plates disposed between the display and the light source.

In such an illumination device, however, since the light is diffused or scattered toward every direction, there arise other problems in that luminous intensity is reduced markedly throughout the display panel and further the structure is relatively complicated and therefore the manufacturing cost is relatively high.

In view of the above description, reference is now made to an embodiment of the illumination device of a light-transmission type display unit according to the present invention.

Figure 2:
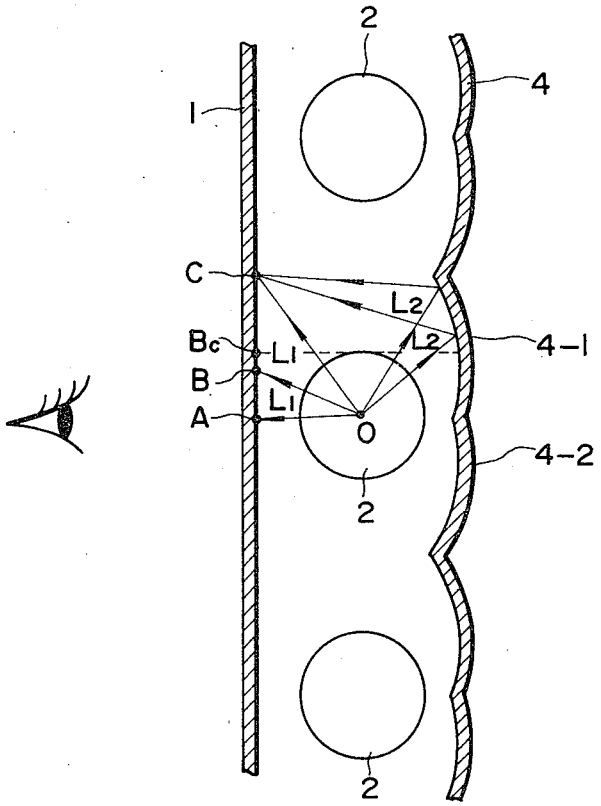
FIG. 2 is a similar sectional diagrammatic view of the illumination device including an elliptical reflector used with a liquid crystal display unit according to the present invention.

FIG. 2 shows an embodiment of the illumination device according to the present invention.

In the figure, the reference numeral 1 denotes a display panel of a light-transmission type display unit, on which letters or figures are displayed, the reference numeral 2 denotes a plurality of tubular light sources such as fluorescent lamps arranged at the back of the display panel 1 at regular intervals, and the reference numeral 4 denotes a reflector plate. The inner surface of the reflector plate 4 is made up of a plurality of unit cells 4-1 and 4-2, the contours of each of which are defined by the union of a pair of parts of two elliptical cylinder surfaces having a common focus coincident with the center of a light source 2 between the display panel 1 and the reflector plate 4 and two other foci lying on the display panel 1 opposite to the boundaries between the unit cells. Further, the axis of the tubular light source is perpendicular to the plane defined by the foci of the corresponding unit cells.

In FIG. 2, rays $L_1$ of light emitted from the center of the light source 2 such as a fluorescent lamp 2 are directly incident upon the inner surface of the liquid crystal display panel 1; rays $L_2$ of light emitted from the light source 2 are indirectly incident upon the inner surface of the liquid crystal display panel 1 after having been reflected by the elliptical cylinder surface of the reflector 4.

Figure 3:
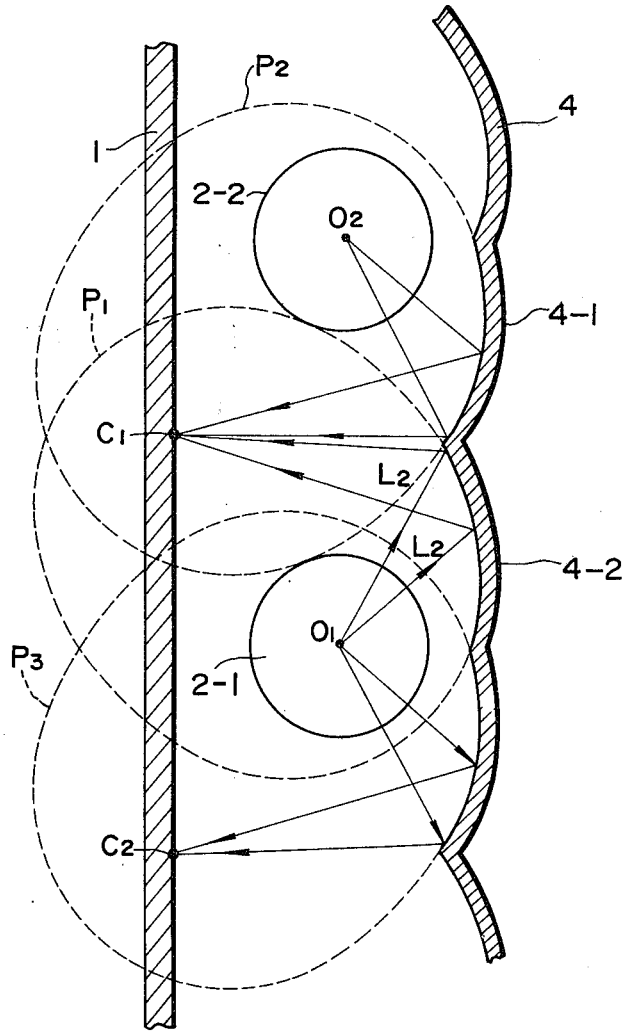
FIG. 3 is an enlarged sectional diagrammatic view of the elliptical reflector according to the present invention shown in FIG. 2.

As depicted in FIG. 3, since the center $O_1$ of the light source 2-1 is located at one focus of a first ellipse $P_1$ and the point $C_1$ of the inner surface of the display panel 1 is located at the other focus of the same ellipse $P_1$, roughly half of the rays of light emitted from the light source 2-1 and reflected by the elliptical reflector 4 are incident near point $C_1$ on the inner surface of the display panel 1. Similarly, since the center $O_2$ of the light source 2-2 is located at one focus of a second ellipse $P_2$ and the point $C_1$ is located at the other focus of the same ellipse $P_2$, roughly half of the rays of light emitted from the light source 2-2 and reflected by the elliptical reflector 4 are incident upon the display panel 1 near point $C_1$.

In FIG. 2, with respect to the rays $L_1$ of light directly incident upon the panel 1, since the distance between points A and O is the shortest, the distance between points B and O is the medium and the distance between points C and O is the longest, the luminous flux density is the greatest at point A, the medium at point B and the smallest at point C. On the other hand, with respect to the rays $L_2$ of light indirectly incident upon the panel 1 after being reflected by the elliptical reflector 4, since the two foci of the ellipse $P_1$ are located at the light source center $O_1$ and the point $C_1$, respectively, all rays $L_2$ of light reflected by reflector 4 are incident upon the panel near the point $C_1$.

Therefore, as compared with the prior-art illuminating device, it is possible to brighten the area near point $C_1$ on the display panel 1. The description has been made on the assumption that the light emitted from only the center of a tubular light source. However, in such an ordinary light source as fluorescent lamp, the light is emitted from the outer cylinder surface thereof and therefore not all of the rays reflected by the reflector are collectively incident upon near point $C_1$ but are dispersedly incident upon the inner surface of the display panel 1, while illuminating the area where the luminous flux density due to the direct rays of light is relatively small. As a result, it is possible to obtain a uniformly-illuminated display panel and thus to make more legible or distinguishable the letters or figures developed on the display panel.

Further, the dimension of the ellipse can be determined in such a way that first a regular interval between two adjacent light sources 2-1 and 2-2 and a distance between the light source center $O_1$ or $O_2$ and the inner surface of the display panel are determined and then the point $C_1$ is automatically determined in the middle of two light source centers $O_1$ and $O_2$. Once the point $C_1$ is fixed, the two ellipses $P_1$ and $P_2$ can be formed with the points $C_1$ and $O_1$ or $O_2$ as their two foci. As depicted in FIG. 3, the long axes of the two adjacent ellipses $P_1$ and $P_2$ are intersected at an appropriate angle nearly at point $C_1$. Further, as depicted in FIG. 3, the ellipses are formed so that two axes of two adjacent ellipses are intersected alternately on the inner surface of the display panel 1.

The description has been made of the case where tubular light sources are used for illuminating the display panel and the inner surface of the reflector plate is defined by a plurality of parts of elliptical cylinder surfaces. However, it is also possible to apply the present invention to the case where point light sources such as bulb lamps are used for illuminating the display panel. In this case, it is possible to attain the similar effect by using a reflector plate 4 made up of a plurality of unit cells, the contours of each of which are defined by the union of a pair of parts of two ellipsoidal surfaces having a common focus coincident with the center of a light source and two other foci lying on the display panel.

Further, although elliptical cylinder surface and ellipsoidal surface have been described hereinabove, since it is not easy to manufacture these surfaces precisely, it is possible to substitute these elliptical surfaces by a part of cylinder surface or spherical surface or a great number of flat surfaces.

Furthermore, it is of course possible to apply this invention to an illuminating device provided with only a single light source.

The present invention has been described mainly for a liquid crystal display unit by way of example; however, it is also possible to apply this elliptical relector to a display unit using an electrochromic element.

As described above, in a transmission-type display unit having light sources and a reflector to reflect the light emitted from the light sources toward the display panel, since there is provided a reflector the inner surface of which is defined by the contours of a plurality of ellipses or ellipsoids arranged in such a way that one of two foci of each of the two adjacent ellipses is located at the center of one of the two adjacent light sources and the other of two foci thereof is located approximately in the middle of two adjacent light sources and on the inner surface of the display panel, it is possible to relatively uniformly illuminate the display panel therethroughout and to realize a display unit by which letters or figures displayed on the display panel are more legible or distinguishable.

It will be understood by those skilled in the art that the foregoing description is in terms of a preferred embodiment of the present invention wherein various changes and modifications may be made without departing from the spirit and scope of the invention, as set forth in the appended claims.

What is claimed is:

1. An illuminating device for a display unit which comprises:

(a) a display panel on which some letters or figures are displayed;

(b) at least one light source disposed at the back of said display panel for illuminating said display panel; and (c) a reflector disposed at the back of said at least one light source, the inner surface of which is made up of at least two unit cells, the contours of each of which are defined by the union of a pair of parts of elliptical surfaces arranged in such a way that one of two foci of each of the elliptical surfaces is located at the center of said light source and the other of two foci thereof is located on the inner surface of said display unit.

2. An illuminating device for a display unit as set forth in claim 1, wherein in the case where a plurality of light sources are disposed at the back of said display panel, the inner surface of said reflector is defined by the contours of a plurality of parts of elliptical surfaces arranged in such a way that one of two foci of each of the two adjacent elliptical surfaces is located at the center of one of said two adjacent light sources and the other of two foci thereof is located approximately in the middle of said two adjacent light sources and on the inner surface of said display panel, the two long axes of said adjacent elliptical surfaces being alternately intersected at an angle near the inner surface of said display panel.

3. An illuminating device for a display unit as set forth in either claim 1 or 2, wherein in the case where said light source is a tubular light source, the elliptical surfaces are elliptical cylinder surfaces.

4. An illuminating device for a display unit as set forth in either claim 1 or 2, wherein in the case where said light source is a spherical light source, the elliptical surfaces are ellipsoidal surfaces.

5. An illuminating device for a display unit as set forth in claim 3, wherein said tubular light source is a fluorescent lamp.

6. An illuminating device for a display unit as set forth in claim 4, wherein said spherical light source is a bulb lamp.

7. An illuminating device for a display unit as set forth in either claim 1 or 2, wherein said display panel is a liquid crystal display panel.

8. An illuminating device for a display unit as set forth in either claim 1 or 2, wherein said display panel is an electrochromic display panel.

9. An illuminating device for a display unit which comprises:

(a) a display panel on which some letters or figures are displayed;

(b) at least one tubular light source disposed at the back of said display panel for illuminating said display panel; and (c) a reflector disposed at the back of said at least one light source, the inner surface of which is made up of at least two unit cells, the contours of each of which are defined by the union of a pair of parts right circular cylinder surfaces.

10. An illuminating device for a display unit as set forth in claim 9, wherein a plurality of light sources are disposed at the back of said display panel, and the inner surface of the reflector is defined by the contours of a plurality of parts of right circular cylinder surfaces.

11. An illuminating device for a display unit which comprises:

(a) a display panel on which some letters or figures are displayed;

(b) at least one tubular light source disposed at the back of said display panel for illuminating said display panel; and (c) a reflector disposed at the back of said at least one light source, the inner surface of which is made up of at least two unit cells, the contours of each of which are defined by the union of a pair of great numbers of flat surfaces.

12. An illuminating device for a display unit as set forth in claim 11, wherein a plurality of light sources are disposed at the back of said display panel, and the inner surface of said reflector is defined by the contours of a plurality of great numbers of flat surfaces.

13. An illuminating device for a display unit which comprises:

(a) a display panel on which some letters or figures are displayed;

(b) at least one spherical light source disposed at the back of said display panel for illuminating said display panel; and (c) a reflector disposed at the back of said at least one light source, the inner surface of which is made up of at least two unit cells, the contours of each of which are defined by the union of a pair of parts of spherical surfaces.

14. An illuminating device for a display unit as set forth in claim 13, wherein a plurality of light sources are disposed at the back of said display panel, and the inner surface of said reflector is defined by the contours of a plurality of parts of spherical surfaces.

15. An illuminating device for a display unit which comprises:

(a) a display panel on which some letters or figures are displayed;

(b) at least one spherical light source disposed at the back of said display panel for illuminating said display panel; and (c) a reflector disposed at the back of said at least one light source, the inner surface of which is made up of at least two unit cells, the contours of each of which are defined by the union of a pair of parts of approximately elliptical surfaces, each surface defined by a great number of flat surfaces.

16. An illuminating device for a display unit as set forth in claim 15, wherein a plurality of spherical light sources are disposed at the back of said display panel, and the inner surface of said reflector is defined by the contours of a plurality of parts of said approximately elliptical surfaces.

* * * * *